US006621375B2

(12) United States Patent
Vezmar et al.

(10) Patent No.: US 6,621,375 B2
(45) Date of Patent: Sep. 16, 2003

(54) N PORT FEED DEVICE

(75) Inventors: John Vezmar, Marshall, MI (US); Scott Cook, Garner, NC (US); Brian Sawyer, Clayton, NC (US)

(73) Assignee: Channel Master LLC, Smithfield, NC (US)

( * ) Notice: Subject to any disclaimer, the term of this patent is extended or adjusted under 35 U.S.C. 154(b) by 0 days.

(21) Appl. No.: 10/045,667

(22) Filed: Mar. 21, 2002

(65) Prior Publication Data

US 2003/0151467 A1 Aug. 14, 2003

(51) Int. Cl.[7] ..... H01P 5/12
(52) U.S. Cl. ..... 333/125; 333/137; 333/21 R
(58) Field of Search ..... 333/122, 125, 333/135, 137, 126, 21 A, 21 R, 33, 34, 35

(56) References Cited

U.S. PATENT DOCUMENTS

| | | | | |
|---|---|---|---|---|
| 4,704,611 A | * | 11/1987 | Edwards et al. | 342/367 |
| 5,617,108 A | * | 4/1997 | Silinsky et al. | 343/786 |
| 6,060,961 A | | 5/2000 | Moheb et al. | 333/126 |
| 6,087,908 A | * | 7/2000 | Haller et al. | 333/122 |
| 6,313,714 B1 | * | 11/2001 | Junker et al. | 333/125 |

* cited by examiner

*Primary Examiner*—Robert Pascal
*Assistant Examiner*—Dean Takaoka

(57) ABSTRACT

A waveguide device having a plurality of waveguide members is provided. The waveguide device is of an integral cast construction and is configured so that the cross-sectional dimensions of each waveguide member decrease along an axis thereof from one end to the other end. Methods of forming the waveguide device are also provided.

32 Claims, 6 Drawing Sheets

N PORT FEED DEVICE

TECHNICAL FIELD

This invention relates to an N port feed waveguide device which supports multiple signals having multiple frequencies and polarities. More specifically, this invention relates to an N port feed waveguide device that separates signals by polarity and when coupled with discrete filters, separates signals by frequency and is configured so that it can be produced in a single casting process.

BACKGROUND OF THE INVENTION

As technology advances, an increasing number of reflector antenna applications, including satellite and other antenna type applications, require complex multi-port assemblies to support the multiple polarities and multiple frequency band signals that are used in such assemblies. Typically, these assemblies that support such polarities and frequencies are referred to as waveguides. The complexity increases and certain difficulties arise when in addition to the input port in which the signals are all received, these systems also further require signals having multiple polarities to be transmitted and signals having multiple polarities to be received.

In response to such needs, assemblies have been developed to process such signals; however, these conventional assemblies have a number of associated deficiencies. For example, the time and complexity for manufacturing conventional N port feed devices are considerable and thus, the overall cost of the manufacturing process significantly increases as the complexity and number of waveguide components increase.

N port feed devices, such as a diplexer, are typically connected between a feed horn and transmitter and receiver hardware that is used to frequency select the signals that are uplinked and downlinked. A diplexer, such as a co-polarized diplexer, uses waveguide filters and a waveguide junction to separate the co-polarized uplink and downlink signals presented to the co-polarized diplexer in a first waveguide and to feed separate transmitter and receiver hardware in a second waveguide. In order to select appropriate, desired downlink and uplink frequencies, the diplexer may have a number of filters formed therewith permitting tuning of these frequencies. For example, a bandpass filter and a high pass filter may be provided as part of the diplexer to provide frequency tuning. The tuning is accomplished by turning multiple bandpass tuning screws and multiple high pass tuning screws. Thus, this type of device suffers from the disadvantage that it requires multiple tuning filters, including tuning screws, to be provided and then manipulated in order tune the diplexer to appropriate frequencies so that acceptable performance is achieved.

FIG. 1 is an illustration of a conventional N port feed device 10. In this case, the N port feed device 10 is a Ku band four port feed wide band. As is clearly visible in FIG. 1, the N port feed device 10 has a complex structure due to its complex geometric design. Because of the complex geometric design, the manufacture and assembly of the N port feed device 10 is likewise complex and requires a number of manufacturing and assembly steps. This adds considerable cost to the manufacturing of the N port feed device 10. The geometric design of the N port feed device 10 is complex because it includes a number of curved sections and the different waveguides each have different sections of varying cross-sectional dimensions. This prevents the N port feed device 10 from being manufactured using a single die cast manufacturing process as one or more casting tools, i.e., mandrels, are unable to be slidably removed from the cast structure surrounding the tools due to the geometry of the design. Typically, the N port feed device 10 is formed as different components and then is assembled together. For example, the individual components can be separately manufactured using a die cast process and then connected to one another using suitable techniques, such as fasteners or a welding operation, etc.

FIG. 2 is a side view of another conventional N port feed device 20. In this instance, N port feed device 20 is a three port feed device (N=3) which is formed of a first part 22 and a second part 24. The first and second parts 22, 24 are formed separately using standard manufacturing processes, such as die casting, and then the two parts 22, 24 are secured to one another using a plurality of fasteners 26, e.g., bolts. This device 20 is also of conventional design as a number of separate components are first fabricated and then assembled at a later time.

Accordingly, it is desirable to provide an N port feed device that separates signals by polarity and when coupled with discrete filters separates signals by frequency, wherein the N port feed device is simple and inexpensive to manufacture and does not require tuning.

SUMMARY OF THE INVENTION

According to one embodiment of the present invention, a waveguide assembly of an integral cast construction is provided and includes a plurality of integral waveguide members. A first waveguide member is provided and configured to carry a first signal having first and second polarities. A second waveguide member is co-axially aligned with the first waveguide member and configured to carry a second signal having at least one polarity. The second waveguide member communicates with the first waveguide member through a first coupling aperture.

The device also includes third and fourth waveguide members that are in communication with an interior of the first waveguide member. The waveguide members are arranged so that the first signal is separated as it is carried within first waveguide member such that the first polarity is separated and carried within the third waveguide member and the second polarity is separated and carried within the fourth waveguide member.

According to one aspect, each of the first, second, third and fourth waveguide members has a cross-section that decreases along an axis containing the waveguide in a direction from a distal end to a proximal end. The device functions as an N port feed device and acts to separate polarized input signals that are received, i.e., through a feed horn, and channeled into the first waveguide member. In one embodiment, the second waveguide member is a transmit port that is attached to a radio or the like. The transmit port receives transmit signals that travel therein and through the first aperture and into the first waveguide member. The third and fourth waveguide members act as side receive ports that are each configured to receive only a signal of one polarity, while the other polarity is cut off.

The present N port feed configuration is designed so that it is non-tunable and is able to be manufactured using a single die casting operation to thereby produce the integral cast construction due to its shape. The more complex geometric configurations of conventional devices prevent a die casting operation from being used. The use of a single die casting operation results in reduced manufacturing costs and reduced manufacturing time.

Other features and advantages of the present invention will be apparent from the following detailed description when read in conjunction with the accompanying drawings.

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF THE PREFERRED EMBODIMENTS

Figure 3:
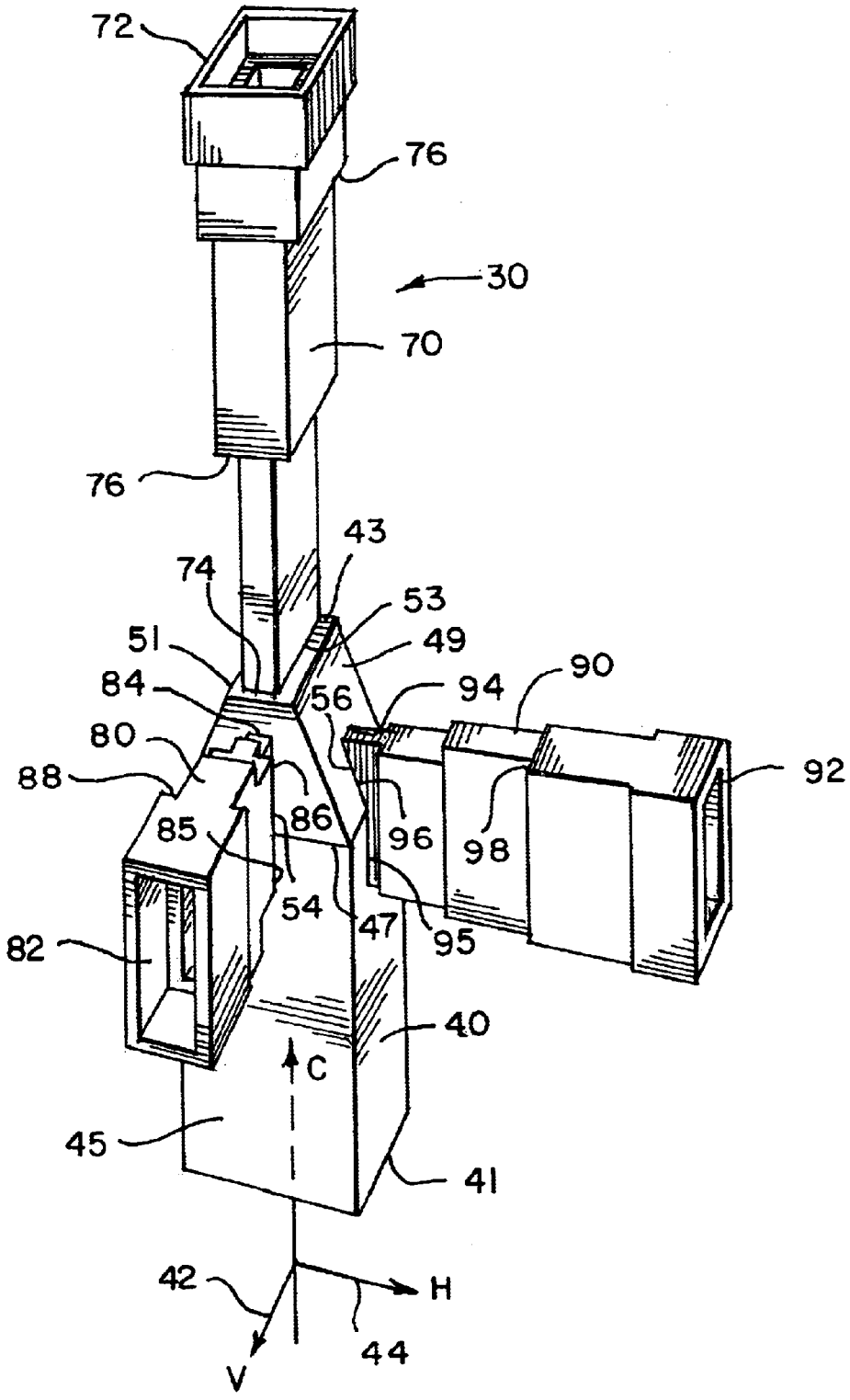
FIG. 3 is a perspective view of an N port feed device according to one exemplary embodiment.

Referring first to FIG. 3, an N port feed device according to one embodiment is provided and generally indicated at 30. The N port feed device 30 includes a common port 40, two side ports 80, 90 and an axial port 70 which is axially aligned with the common port 40. The common port 40 is a waveguide aligned along a common axis C, and is suitable for carrying at least two differently polarized signals, represented in FIG. 3 as polarized vectors 42, 44. Signal 42 has a first polarization, designated "V", and is centered about frequency f(v) with wavelength λ(v). Signal 44 has a second polarization, designated "H", and is centered about frequency f(h) with wavelength λ(h). It will be appreciated that the use of V and H is for simplicity and is not intended to limit the polarity of the signals that may be carried by the common port 40 and the side ports 80, 90, or to limit the polarizations to only those polarized signals that are orthogonal. Instead, the N port feed device 30 should be thought of as a device which serves to separate signals of different polarity.

The common port 40 serves as an interface between the device 30 and a feed horn (not shown) which may comprise a broad band, a multi band or a dual band feed horn. The various signals, e.g., V and H signals 42, 44, are received, i.e., through the feed horn, and channeled into the common port 40. The feed horn is complementary to the common port 40 in that the feed horn is designed to support signals having several polarities.

The exemplary common port 40 is a rectangular waveguide that has a first end 41 and a second end 43 with the first end 41 having an opening which mates with the feed horn. The common port 40 is a generally hollow structure that is defined by four side walls. The common port 40 has a base section 45 that extends from the first end 41 to a junction 47 and a tapered section 49 that extends from the junction 47 to the second end 43. The base section 45 therefore has a generally rectangular cross-section that in one embodiment is constant from the first end 41 to the junction 47. At the junction 47, the four sides of the common port 40 begin to taper inwardly to a top base 51. The top base 51 has an opening 53 (coupling aperture) formed therein for establishing a connection between the common port 40 and the axial port 70.

The degree of taper of the tapered section 49 is carefully selected so that the cut-off frequency of this narrower section of the common port 40 is higher than the frequency of the signals 42, 44 received and traveling within the base section 45. As a consequence and as will be described in greater detail hereinafter, the signals 42, 44 received in the common port 40 can not travel into the axial port 70. The opening at the first end 41 is therefore of smaller cross-sectional area than the opening 53 (coupling aperture) formed in the top base 51.

The common port 40 also has a pair of side openings (coupling apertures) formed therein for establishing a connection between the common port 40 and the two side ports 80, 90. In the exemplary embodiment, a first side opening 54 and a second side opening 56 are formed in two respective side walls of the common port 40. The first side opening 54 is formed in a first side wall and the second side opening 56 is formed in a second side wall that is orientated 90 degrees from the first side wall. In one embodiment, each of the first and second side openings 54, 56 are formed partially in one respective wall of the base section 45 and in one respective adjacent wall of the tapered section 49. In other words, each of the first and second side openings 54, 56 extends from the base section 45 to the tapered section 49. The first and second side openings 54, 56 have a shape which is complementary to the shape of the distal ends of the side ports 80, 90. These first and second side openings 54, 56 permit communication between the interior of the side ports 80, 90 and the interior of the common port 40 and thus they are often referred to as coupling apertures.

The axial port 70 is a waveguide structure and in the embodiment of FIG. 3 acts as a transmit port. The axial port 70 is also a rectangular waveguide in this embodiment and has a first end 72 and an opposing second end 74. Similar to the.common port 40, the axial port 70 is a hollow structure with an opening formed both at the first end 72 and at the second end 74. The axial port 70 has a stepped configuration such that the cross-sectional area of the axial port 70 is greatest at the first end 72 and smallest at the second end 74. The stepped configuration of the axial port 70 results in the axial port 70 having a number of spaced shoulder sections 76 defined where one stepped section of the axial port 70 joins an adjacent section.

It will be understood that the axial port 70 does not have to have a rectangular cross-sectional shape so long as the axial port 70 progressively tapers inwardly in a direction away from the first end 72 or has a stepped configuration in which the greatest cross-sectional area of the axial port 70 is at the first end 72. It is important that the cross-sectional area of the axial port 70 does not increase along the length of the axial port 70 from the first end 72 to the second end 74. In the illustrated embodiment, the axial port 70 includes a series of stepped sections each having a rectangular cross-section. It will be appreciated that the cross-section of the hollow interior area of the axial port 70 likewise decreases from the first end 72 to the second end 74 and therefore any signals traveling into the first end 72 and toward the second end 74 are directed into progressively narrower waveguide sections until the junction between the axial port 70 and the common port 40.

The dimensions of the second end 74 of the axial port 70 are complementary to the common port 40 so as to permit the second end 74 to integrally extend from the planar top base 51 of the common port 40. As will be described in great detail hereinafter, the common port 40 and the axial port 70 are preferably integrally formed as a single cast structure. The opening at the second end 74 is aligned with and has complementary dimensions as the opening 53 formed in the top base 51 at the second end 43 of the common port 40. This permits certain, select signals to be communicated between the axial port 70 and the common port 40. In one preferred embodiment, the dimensions of the opening at the second end 74 and the opening 53 of the common port 40 are approximately equal.

The side ports 80, 90 have similar features as the common port 40 and particularly the axial port 70. In the exemplary embodiment illustrated in FIG. 3, the side ports 80, 90 are identical to one another; however, it will be understood that the side ports 80, 90 may have different configurations from one another. The two side ports 80, 90 are both waveguides and in the exemplary embodiment have rectangular shapes. The side port 80 has a first distal end 82 and an opposing second end 84 which is integrally connected to one side wall of the common port 40. The side port 80 is a generally hollow structure having an opening extending therethrough from the first end 82 to the second end 84.

In the exemplary embodiment, the second end 84 of the side port 80 does not include a planar edge due to the side opening 54 being formed both on the sidewall of the base section 45 and the corresponding side wall of the adjacent tapered section 49. The second end 84 of the side port 80 thus includes a first section 85 that is integrally connected to and extends away from the base section 45. The second end 84 is also formed of a second section 86 that is complementary to and integrally connected with the tapered section 49. The second section 86 is therefore a beveled section with an angle being defined between a plane containing the second section 86 and a plane containing the first section 85. This angle is approximately the same angle formed between planes containing the base section 45 and the tapered section 49. The opening formed at the end of the second end 84 preferably has the same dimensions as the side opening 54 so as to permit signals to communicate between the interior of the side port 80 and the interior of the common port 40.

As with the axial port 70, the side port 80 has a stepped configuration. The side port 80 is thus formed of a number of stepped sections (in this case rectangular) which progressively diminish in cross-sectional area from the distal first end 82 toward the second end 84. A shoulder section 88 is formed between adjacent stepped sections.

It will be understood that the side port 80 is not limited to having a rectangular cross-sectional shape so long as the side port 80 progressively tapers inwardly in a direction away from the distal first end 82 or has a stepped configuration in which the greatest cross-sectional area of the side port 80 is at the first end 82. It is important that the cross-sectional area of the side port 80 does not increase along the length of the side port 80 from the first end 82 to the second end 84. It will be appreciated that the hollow interior area of the side port 80 likewise decreases from the first end 82 to the second end 84 and therefore any signal traveling into the second end 84 and toward the distal first end 82 is directed into progressively larger interior waveguide sections as the signal travels away from the common port 40.

In the exemplary embodiment illustrated, the side port 90 is identical in shape to the side port 80. The side port 90 includes a distal first end 92 and an opposing second end 94 integrally formed with and extending away from one side wall of the common port 40. The second end 94 of the side port 90 includes a first section 95 that is integrally connected to and extends away from the base section 45 and a second section 96 that is integrally connected to and extends away from the tapered section 49. The second section 96 is therefore a beveled section with an angle being defined between a plane containing the second section 96 and a plane containing the first section 95.

Similar to the other ports, the side port 90 has a stepped configuration. The side port 90 is thus formed of a number of stepped sections (in this case rectangular) that progressively decrease in cross-sectional area from the distal first end 92 toward the second end 94. A shoulder section 98 is formed between adjacent stepped sections.

In one embodiment, as shown in FIG. 3, the first and second side openings 54, 56 are formed in the same region of their respective side walls such that an upper edge of each of the openings 54, 56 are aligned and a lower edge of each of the openings 54, 56 are aligned. Accordingly, the first and second openings 54, 56 are formed in the same location along the common axis C with the difference being that the openings 54, 56 are offset 90 degrees from one another. This causes the side ports 80, 90 to be located along the same x-coordinates (common axis C) of the common port 40 with the side ports 80, 90 themselves being off set from one another, e.g., 90 degrees.

The side ports 80, 90 are located at a position prior to the second end 43 of the common port 40 where the common port 40 transitions into the axial port 70 to permit the H, V signals entering the common port 40 to be separated into the side ports 80, 90 depending upon their individual polarity.

The device 30 functions as an N port feed device and acts to separate polarized input signals that are received, i.e., through the feed horn, and channeled into the common port 40. For example, V and H polarity signals are channeled into the common port 40 and travel within the interior of the common port 40 toward the second end 43. The side ports 80, 90 are connected to the common port 40 by way of coupling apertures (side openings 54, 56) which are configured to only permit a signal of a certain polarity pass therethrough into one of the respective side ports 80, 90. For example, as illustratively shown with the V and H signals vectors of FIG. 3, the relative polarity of the signal components as they are directed outwards from the common axis C of the common port 40 and into the side ports 80, 90 is dependent, on the position along the axis at which the signal is measured.

In the exemplary embodiment, the coupling aperture defined by side opening 54 is configured such that the V polarity signal 42 is cut off and therefore does not pass into the side port 80 which may be thought of as the H side port. In contrast, the coupling aperture defined by side opening 56 is configured to accept the V polarity signal and pass the signal into the side port 90 (the V side port). The side port 90 (V port) is therefore able to accept the V polarity signal 42 and pass it through to components downstream of the side port 90. Similarly, the side port 80 (H port) accepts the H polarity signal 44 and passes it through to components downstream of the side port 80. In this embodiment, each of the side ports 80, 90 acts as a receiver port which receives one type of polarity signal that has been channeled into the common port 40 and then separated therein into a corresponding H receiver port 80 and V receiver port 90 according to the polarity of the signal. In one embodiment, the receiver ports 80, 90 are each connected to a filter/LNB (low noise block downconverter) device or the like for the purpose of further filtering of the respective polarized signal. For example, the polarized signals may be further separated based on frequency.

The axial port 70 acts in this embodiment as a single transmit port. Typically, the transmit port 70 will be attached to a device, such as a radio or the like. The transmit port 70 receives transmit signals which may be of the same two polarities H and V that are separated into the side ports 80, 90 after entering the common port 40 or the transmit signals may be of different polarity compared to the signals received in the common port 40. The transmit signals enter the first end 72 of the transmit port 70 and travel toward the second end thereof. As the transmit signals travel toward the coupling aperture (opening 53), the cross-sectional dimensions of the transmit port 70 decrease in a step-like manner. As the transmit signals pass through the coupling aperture (opening 53), the transmit signals enter into the common port 40 at the second end 43 thereof. The transmit signals then travel within the common port 40 toward the first end 41.

Figure 4:
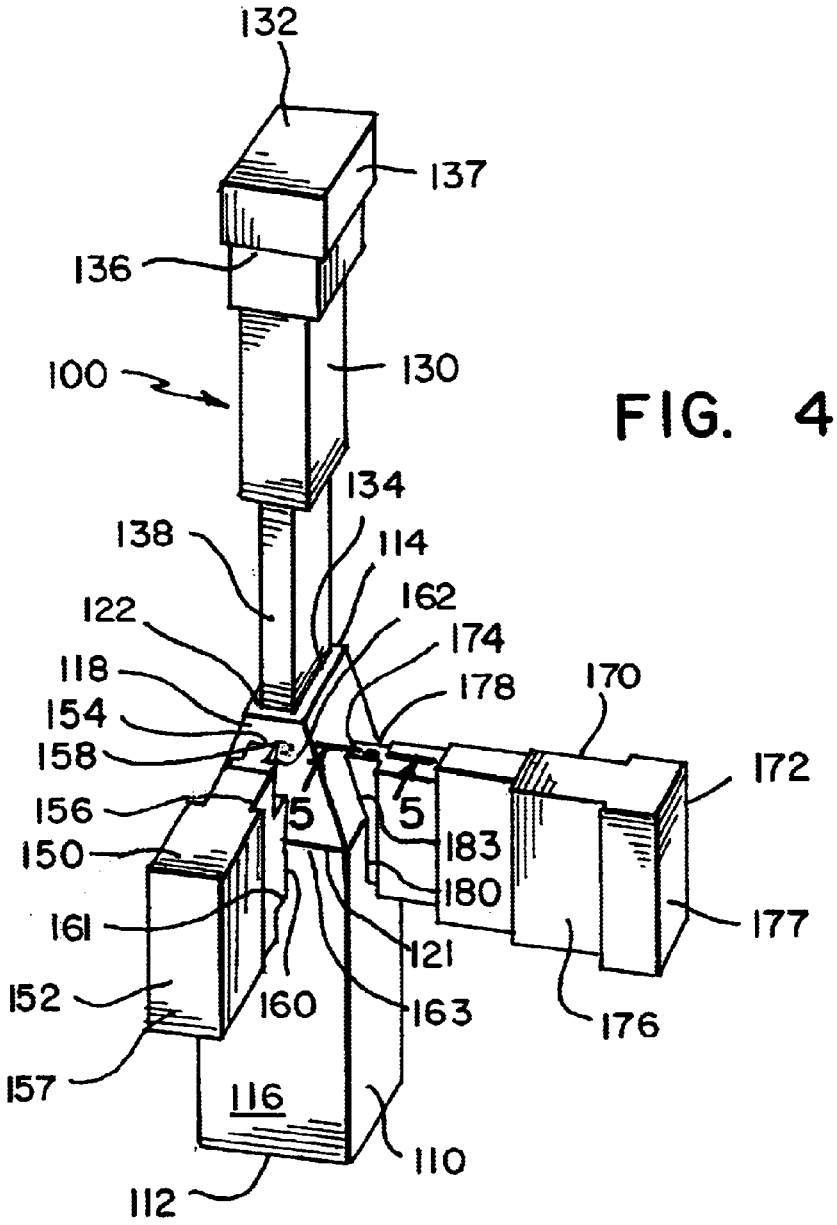
FIG. 4 is a perspective view of casting tools of one exemplary manufacturing process which engage one another during the formation of the exemplary N port feed device of FIG. 3.
Figure 5:
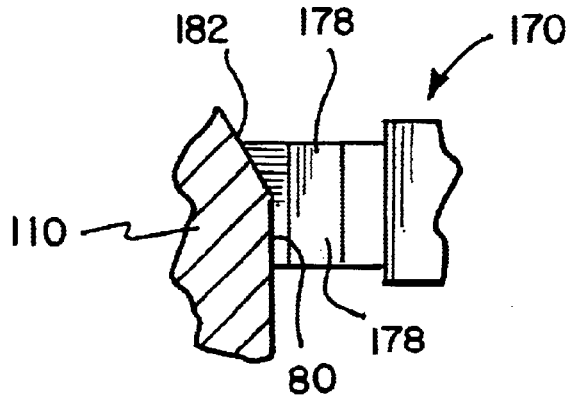
FIG. 5 is a cross-sectional showing a portion of several tools of FIG. 4 where one side tool mates against a base tool.

FIGS. 3 through 5 illustrate a principle advantage of the N port feed device 30, namely that it may be cast as a single integral structure that requires no tuning operations, etc. More specifically, the configuration of the N port feed device 30 permits a single die casting process to be used to manufacture the device 30 as a single, integral cast structure. Because the N port feed device 30 may be formed by a single die casting process, the overall manufacturing costs and manufacturing time are reduced. The N port feed device 30 is therefore preferably formed of materials that may be die cast so as to form the device 30. In general, casting is a very cost effective approach to form waveguide devices; however, up to now, the casting approach was limited to forming individual waveguide components that were then later assembled to form the complete N port feed device. As previously mentioned, the complexity of the geometric shapes prevented a die casting approach from being used to form the entire N port feed device. The present N port feed configuration overcomes these deficiencies and provides a geometric configuration for the N port feed device 30 that permits a die casting approach to be used.

Part of the reason that die casting is very cost effective is that reusable casting tools (i.e., mandrels) are used to manufacture the N port feed device 30. One of the limitations that prevents conventional N port feed devices from being casted around a mandrel or the like is that all internal cavities of the N port feed device must be accessible by one or more slideable, reusable mandrels. Another limitation is that N port feed devices which require tuning mechanisms increase the complexity that must be factored into the reusable casting tools and in many instances, prevent the tunable N port feed device from being manufactured using a single die cast process.

FIG. 4 is a perspective view of reusable die casting tools 100, according to one exemplary embodiment, that are designed for use in a die casting process to manufacture the N port feed device 30 of FIG. 3 as an integral, single cast structure that requires no additional assembly. The die casting tools 100 include a first tool 110, a second tool 130, a third tool 150, and a fourth tool 170. It will be understood that each of the die casting tools 100 may be referred to as a slidable mandrel or slidable member as each comprises a defined structural member which mates with another tool to permit a die cast material to be disposed over the mated die casting tools 100 and then cast, thereby forming the cast structure illustrated in FIG. 3. Each of the die casting tools 100 is formed of a material that is suitable for use in a die casting process. For example, die cast tools 100 are typically formed of metals which can withstand the temperatures and pressures that are observed during a conventional die cast process.

The first casting tool 110 has a shape and dimensions that mirror the interior dimensions of the common port 40. The first casting tool 110 thus has a closed first end 112 and an opposing closed second end 114. The first casting tool 110 has a base section 116 and a tapered section 118 which joins the base section 116 at a junction 120. The base section 116 is generally in the shape of a rectangular column. The tapered section 118 terminates in a platform 122 at the second end 114 of the tool 110. In this exemplary embodiment, the platform 122 is a planar rectangular platform.

The second casting tool 130 has a shape and dimensions that mirror the interior dimensions of the transmit port 70. The second casting tool 130 has a closed first end 132 and an opposing closed second end 134. Because the second casting tool 130 mirrors the interior of the transmit port 70, the second casting tool 130 is formed of a series of stepped sections 136 which are stacked on one another. In this embodiment, each of the sections 136 is in the form of a rectangular member with a base of each section 136 extending from a top platform of an underlying section 136, except the distalmost section 137 which has a solid lowermost surface. As the sections 136 extend toward the common port 40, the cross-sectional area of each section decreases.

A proximalmost section 138 seats against the platform 122 in an engaged position of the die casting tools 100 with the dimensions of the proximalmost section 138 being approximately equal to the dimensions of the opening 53 formed at the second end 43 of the common port 40. At least a peripheral edge of the proximal most section 138 seats against the platform 122. The proximalmost section 138 may therefore have a completely solid, planar end surface that seats against the platform 122 or the proximalmost section 138 may be formed such that only the peripheral lip seats against the platform 122. The later permits the area between the peripheral lip to be either recessed or even hollow.

The third casting tool 150 has a shape and dimensions that mirror the interior dimensions of the side port 80. The third casting tool 150 has a first distal end 152 and an opposing second proximal end 154. The third casting tool 150 is formed of a series of stepped sections 156 which are stacked on one another. In this embodiment, each of the sections 156 is in the form of a rectangular member with a base of each section 156 extending from a top platform of an underlying section 156, except the distalmost section 157 which has a lowermost surface. As the sections 156 extend toward the common port 40, the cross-sectional area of each section decreases.

In this exemplary embodiment, a proximalmost section 158 is not a pure rectangular section but rather is, a beveled section having a first section 160 and a second section 162. The first section 160 includes a planar platform that is shaped so that it seats against the base section 45 of the common port 40 and extends from a lowermost edge 161to a point 163 which corresponds to the location of the junction 47 between the base section 45 and the tapered section 49 of the common port 40. The second section 162 has a shape that is complementary to the tapered section 49 of the common port 40. The second section 162 therefore has a beveled shape.

While, the top surface of the proximalmost section 158 may be a completely solid platform, it will be appreciated that the proximalmost section 158 may have peripheral lip that seats against the common port 40 and an innermost portion of the section 158 between the peripheral lip may be recessed or even hollow as it is the peripheral lip that must seat against the common port 40 to define the boundaries between the integral side port 80 and the common port 40. The peripheral lip defines the side opening 54 (FIG. 3) formed in the common port 40 to provide communication between the interior of the side port 80 and the interior of the common port 40.

In the engaged position of the die casting tools 100, the third casting tool 150 is brought into contact with the first casting tool 110 such that the proximalmost section 158 seats against one side of the common port 40. More specifically, the first section 160 seats against the base section 45 and the second section 162 seats against the tapered section 49 as shown in FIG. 5.

The fourth casting tool 170 is similar to the third casting tool 150 with the fourth casting tool 170 having a shape and dimensions that mirror the interior dimensions of the side port 90. The fourth casting tool 170 has a first distal end 172, an opposing second proximal end 174 and is formed of a series to of stepped sections 176 which are stacked on one another. As the sections 176 extend toward the common port 40, the cross-sectional area of each section decreases. A distalmost section 177 has a solid lower surface and a proximalmost section 178 is a beveled section having a first section 180 and a second section 182. The first section 180 is shaped to seat squarely against the base section 45 of the common port 40, while the second section 182 has a beveled shape that is complementary to the tapered section 49 of the common port 40.

In the engaged position of the die casting tools 100, the fourth casting tool 170 is brought into contact with the first casting tool 110 such that the proximalmost section 178 seats against a side of the common port 40 which is 90 degrees from the side of the common port 40 where the third casting tool 150 is seated against. The first section 180 seats against the base section 45 and the second section 182 seats against the tapered section 49.

The casting tools 100 are part of a conventional die casting assembly and are driven by suitable devices which cause the casting tools 100 to be positioned in the engaged position and then separated therefrom after the die casting operation is completed. Such devices may include a hydraulic system or any other type of system for causing the casting tools 100 to be moved into and out of the engaged position. Typically, the casting tools 100 are integrated into an automated system, such as a robotic system, that is computer controlled.

The casting tools 100 are used with other conventional components of the die casting assembly. For example, the die casting assembly includes an outer shell (not shown), formed of one or more shell parts, which is disposed around the casting tools 100. A casting material is then provided between the outer shell and the die casting tools 100. The casting material thus flows around the die casting tools 100 and then cools and hardens therearound to form the single, integral die cast N port feed device 30 of FIG. 3.

Once the casting material has sufficiently cooled, the die cast tools 100 are slidably removed from the die cast structure. The first, second, third, fourth casting tools 110, 130, 150, 170 are disengaged from one another and slidably removed from the cast structure. Because each of the die cast tools 100 has a tapered or stepped configuration in which the greatest cross-sectional area of each tool is at the distalmost portion of the respective tool, each of the tools 100 can be slidably disengaged and removed from the casting without any damage being done to the cast structure itself.

Figure 6:
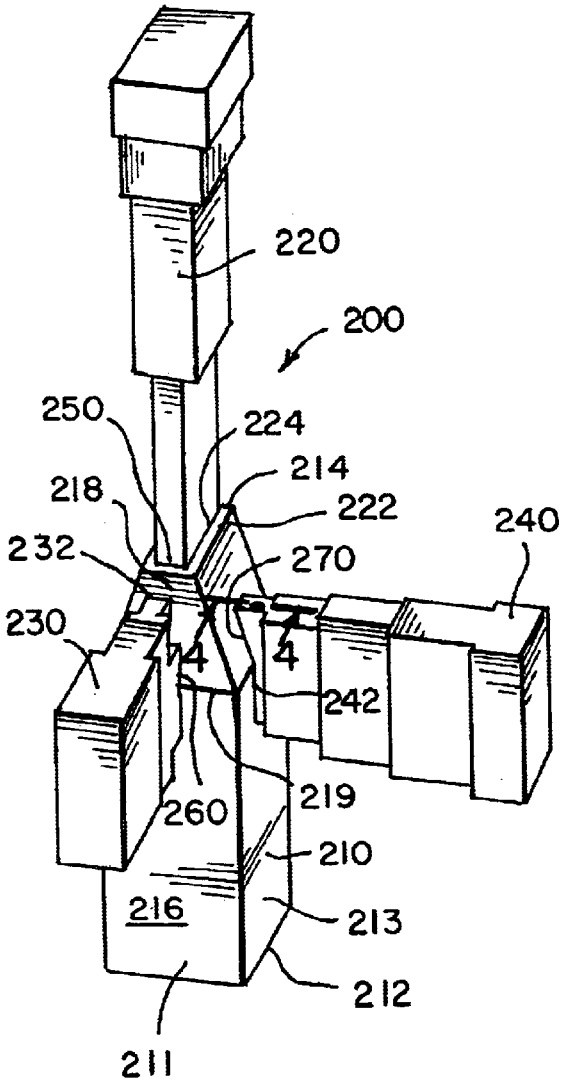
FIG. 6 is a perspective view of casting tools of another exemplary manufacturing process which engage one another to form the exemplary N port feed device of FIG. 3.

FIG. 6 illustrates die casting tools 200 according to another embodiment. This second embodiment is very similar to the first embodiment shown in FIGS. 4 and 5 with the exception that instead of the individual casting tools being moved into an arrangement where they simply contact and seat against one another, the casting tools 200 of this embodiment are received within complementary recesses formed in the base tool (i.e., the common port tool). The die casting tools 200 include a first casting tool 210, a second 130 casting tool 220, a third casting tool 230, and a fourth casting tool 240.

The first casting tool 210 is similar to the first casting tool 110 except that it includes a number of recesses formed in its outer surface. The first casting tool 210 has a closed first end 212 and an opposing closed second end 214. The first casting tool 210 has a base section 216 and a tapered section 218 which joins the base section 216 at a junction 219. The base section 216 is generally in the shape of a rectangular column. The tapered section 218 terminates in a platform 222 at the second end 214 of the tool 210. In this exemplary embodiment, the platform 222 is a planar rectangular platform. A first recess 250 is formed in the platform 222. The first recess 250 has dimensions that are complementary to the dimensions of a first end 224 of the second casting tool 220 so that an intimate fit results between the first end 224 and the edges of the first recess 250. The depth of the first recess 250 is not critical so long as the first end 224 of the second casting tool 220 is sufficiently received in the first recess 250 such that it is retained within the first recess 250 during the casting process such that it is prevented from axial and transverse movement across the surface of the platform 222. The first recess 250 thus serves to locate and partially retain the second casting tool 220.

In this exemplary embodiment, the first recess 250 has a generally rectangular shape; however it will be appreciated that the first recess 250 may have any number of shapes so long as the shape of the first recess 250 and the first end 224 are complementary and permit the mating of the first end 224 within the first recess 250. The fit between the first end 224 and the first recess 250 should be intimate enough such that there are no gaps between the outer surfaces of the first end 224 and the inner surface of the first recess 250. During the casting process, the casting material is disposed over and flows over the casting tools 200 and thus it is undesirable to have any casting material flow into the recess 250. Instead the casting material should flow around the surfaces of the second tool 220 fitted within the first recess 250 and around the surfaces of the first tool 200 itself.

Similarly, the first casting tool 210 has second and third recesses 260, 270, respectively, formed therein. The second recess 260 is formed in a first side 211 of the first casting tool 210, while the third recess 270 is formed in a second side 213 of the first casting tool 210. The first side 211 and the second side 213 are preferably 90 degrees from one another.

Figure 7:
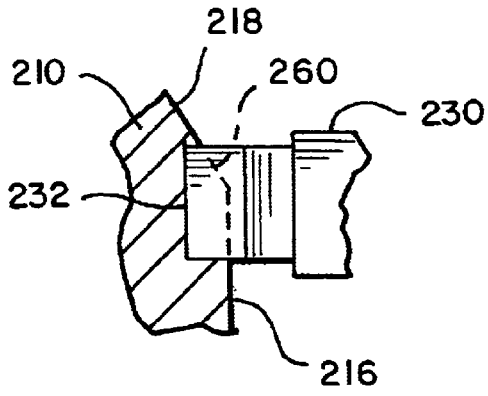
FIG. 7 is a cross-sectional showing a portion of several tools of FIG. 6 where one side tool mates against a base tool.

The second recess 260 receives a first end 232 of the third casting tool 230 and in the exemplary embodiment of FIG. 5, the second recess 260 is formed along the base section 216 of the first tool 210 and the beveled section 218 of the first tool 210. The beveled section 218 extends from the base section 216 and terminates in the platform 222. Unlike the embodiment discussed with reference to FIG. 6, the first end 232 of the third casting tool 230 in this embodiment may include a planar end surface as shown in FIG. 7. Because the first end 232 does not have to be carefully shaped to seat against the outer surfaces of both the base section 216 and the beveled section 218, the first end 232 may be made to have a conventional shape. This reduces costs because the first end 232 does not have to be tailored to each particular application. Instead, a standard tool may be manufactured for use in multiple applications so long as the cross-sectional dimensions of the first end 232 approximate the cross-sectional dimensions of the recess 260.

The third casting tool 230 is driven into the engaged position, as show in FIG. 7, such that the first end 232 is received within the second recess 260. As with the first recess 250, the depth of the second recess 260 is not critical so long as the end surface 233 of the first end 232 extends beyond the perimeteric edge of the first casting tool 210 which defines second recess 260. The fit between the third casting tool 230 and the second recess 260 should be intimate enough such that the casting material is not permitted to freely flow between the first and third casting tools 210, 230 along the peripheral edge of the first casting tool 210.

The third recess 270 receives a first end 242 of the fourth casting tool 240 and is formed partially along the base section 215 and the beveled section 217 of the first tool 210. The first end 242 may be similar or identical to the first end 242 in that it may include a planar end surface. To achieve an intimate fit between the first end 242 and the third recess 270, the cross-sectional dimensions of the first end 242 approximate the cross-sectional dimensions of the third recess 270.

The fourth casting tool 240 is driven into the engaged position such that the first end 242 is received within the third recess 270. As with the second recess 260, the depth of the third recess 270 is not critical so long as the end surface of the first end 242 extends beyond the perimeteric edge of the first casting tool 210 which defines third recess 270. The fit between the fourth casting tool 240 and the third recess 270 should be intimate enough such that the casting material is not permitted to freely flow between the first and fourth casting tools 210, 240 along the perimeteric edge of the first casting tool 210.

During the casting process, the casting tools 200 are actuated by using a controller or the like (not shown) which causes the casting tools 200 to be driven from a resting state into the engaged state where each of the second, third and fourth casting tools 220, 230, 240 are disposed and retained within the respective recesses formed in the first casting tool 210. The controller is preferably a computer based system and may be an automated system.

Figure 1:
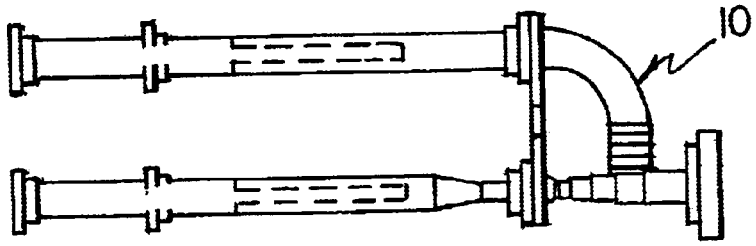
FIG. 1 PRIOR ART
FIG. 1 is a side elevational view of a conventional four port feed device.
Figure 2:
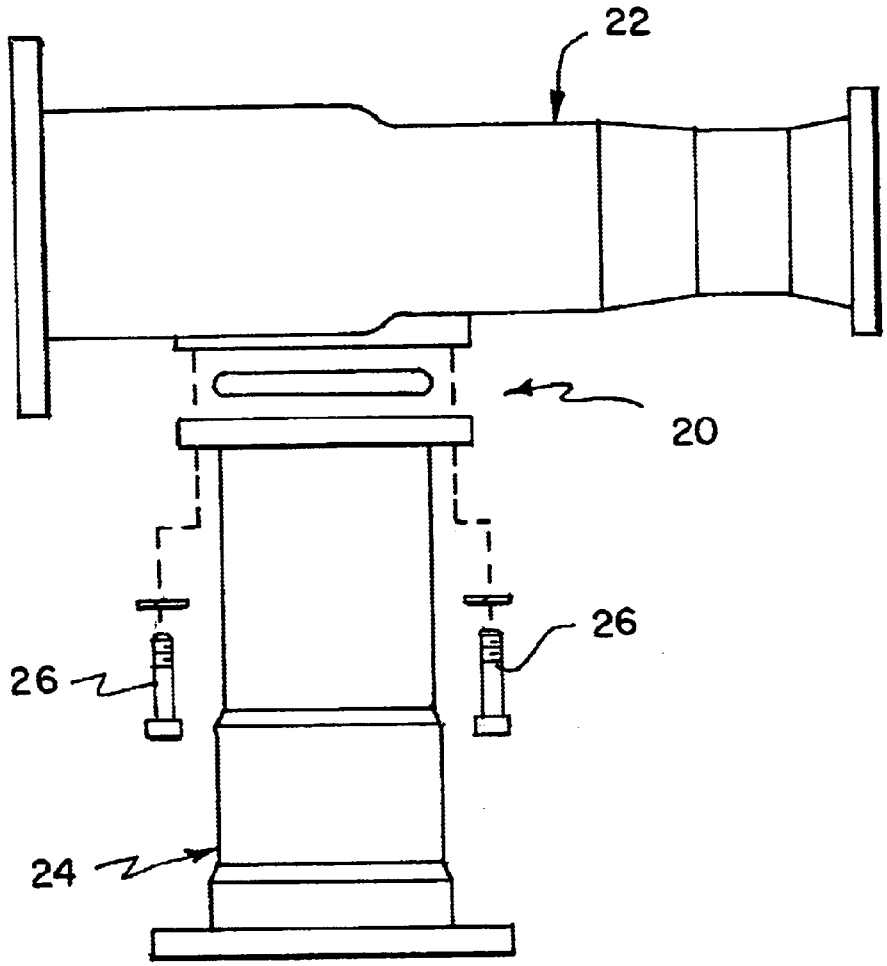
FIG. 2 PRIOR ART
FIG. 2 is an exploded side elevational view of a conventional three port feed device.

The conventional N port feed devices shown in FIGS. 1 and 2 are unable to be die cast using a single casting process because the cross-sectional dimensions of various sections of the N port feed device prevent a die casting tool from being slidably removed from the cast structure. The inability to use die casting tools is largely due to the geometric design of the waveguide components of the N port feed device. The difficulty arises when the casting tools are slidably removed from the cast N port feed structure that surrounds the casting tools. Because the tool must be slidably withdrawn through the interior of the cast structure, the tool cannot have any features, e.g., a flange or other protuberance, that will contact the cast structure because these features are unable to fit within the confines of the interior as the tool is being slidably withdrawn.

Furthermore, the N port feed device 30 of FIG. 3 is not a tunable device and therefore does not require tuning features to be incorporated into the N port feed device 30. This is in contrast to the conventional N port feed device 10, shown in FIG. 1, that includes tuning screws connected to a tuning section of the N port feed device 10.

Figure 8:
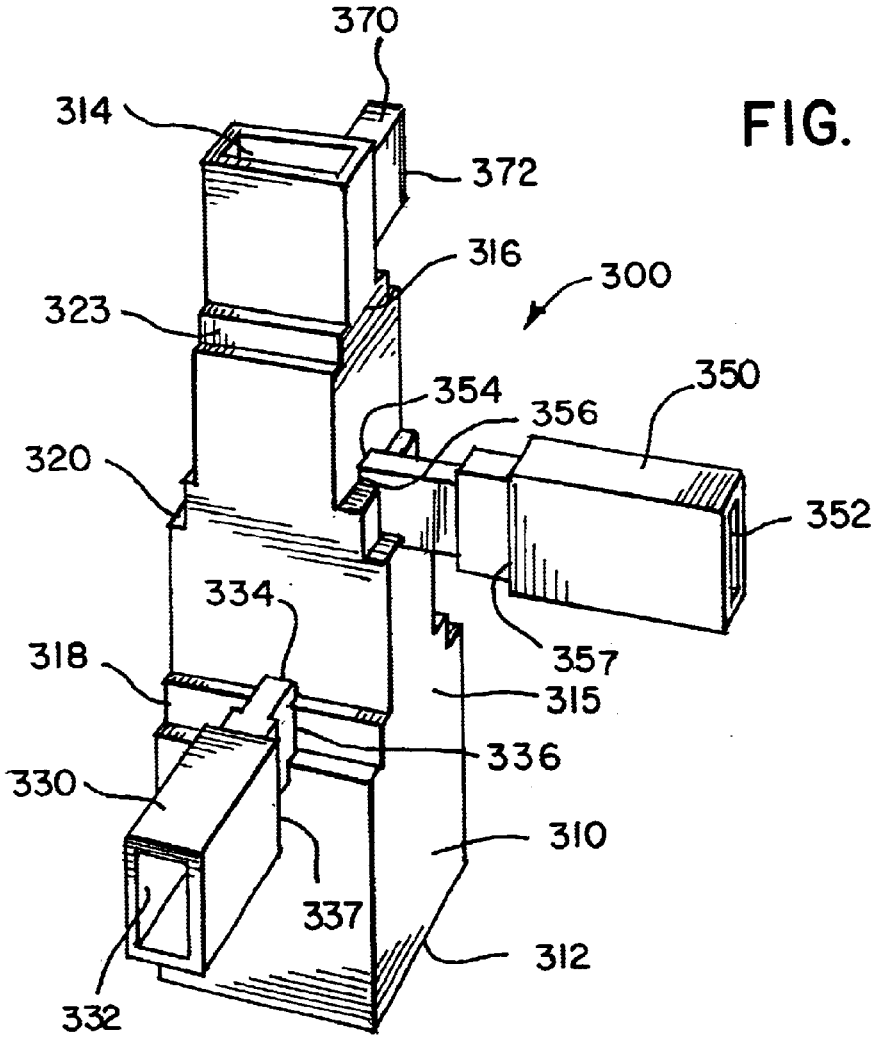
FIG. 8 is a perspective view of an N port feed device according to another exemplary embodiment.
Figure 9:
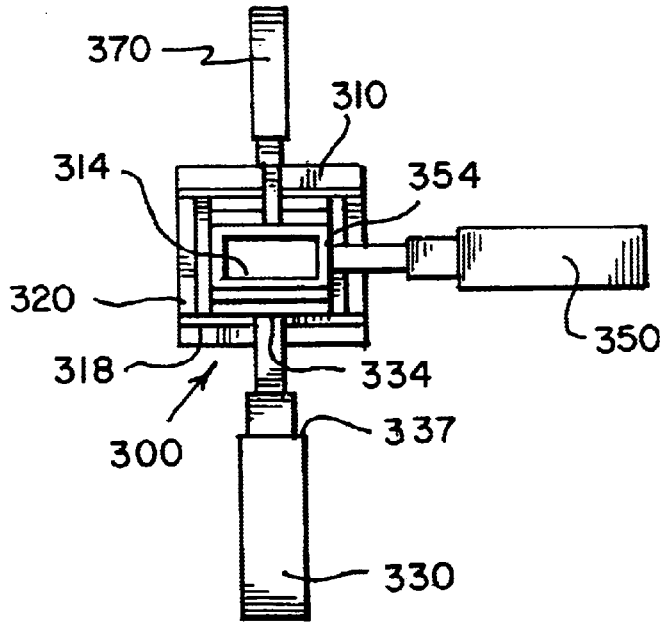
FIG. 9 is a top plan view of the N port feed device of FIG. 8.

FIGS. 8 and 9 illustrate another embodiment. An N port feed device 300 is provided and in this embodiment N=5. Many of the features of the N port feed device 300 are present in the N port feed device 30 of FIG. 3 with N port feed device 300 also being configured so that it can be formed as an integral die cast structure. N port feed device 300 includes a first waveguide member 310, second and third side waveguide members 330, 350 and a fourth side waveguide member 370.

The first waveguide member 310 is an elongated hollow waveguide structure having a first end 312 and a second end 314. Both the first and second ends 312, 314 are open to permit signals to travel into and out of each end 312, 314. In this embodiment, the first waveguide member 310 acts as a common port 315 and a first transmit port 316 with the common port 315 extending from the first end 312 to an intermediate junction (not shown) where the common port 315 joins the first transmit port 316. The first transmit port 316 extends from this junction to the second end 314.

As best shown in FIG. 8, the first waveguide member 310 has a generally stepped configuration which is defined by a first stepped region 318 and a second stepped region 320. The first stepped region 318 is formed of one or more inwardly stepped sections. The second stepped region 320 is likewise formed of one or more inwardly stepped sections. Both the first and second stepped regions 318, 320 are formed in the common port 315. Because the first and second stepped regions 318, 320 are inwardly stepped, the cross-sectional dimensions of the common port progressively decrease from the first end 312 to the junction.

The junction between the common port 315 and the first transmit port 316 is carefully configured so that the cut-off frequency of the narrower section of the common port 315 (proximate the junction) is higher than the frequency of the signals 42, 44 (FIG. 3) that are received at the first end 312 and travel within the common port 315. As a consequence, the signals 42, 44 that are received in the common port 315 from the first end 312 can not travel into the first transmit port 316.

The first transmit port 316 also has a stepped configuration in that a third stepped region 323 is formed along the length of the first transmit port 316. As with the other stepped regions, the third stepped region 323 includes one or more stepped sections. The third stepped region 323 is also inwardly stepped so that the cross-sectional dimensions of the first transmit port 316 decrease from the junction to the second end 314. Accordingly, the cross-sectional dimensions of the first waveguide member 310 are greatest at the first end 312 and smallest at the second end 314. In the intermediate area between the first and second ends 312, 314, the cross-sectional dimensions progressively decrease at the respective stepped regions.

The second and third side waveguide members 330, 350 are integrally connected to the common port 315 of the first waveguide member 310 and extend outwardly therefrom. The second and third side waveguide members 330, 350 are also hollow waveguide members with the second side waveguide member 330 mating with and extending from the first stepped region 318 and the third side waveguide member 350 mating with and extending from the second stepped region 320.

In contrast to the device 30 of FIG. 3, the waveguide members (second and third side waveguide members 330, 350) of this embodiment that are attached to and in communication with the interior of the common port 315 are not aligned with each other along the longitudinal axis of the common port 315. Instead, the second and third waveguide members 330, 350 are offset from one another relative to the longitudinal axis of the common port 315.

The second and third side waveguide members 330, 350 have similar features relative to the first waveguide member 310 in that each of the second and third side waveguide members 330, 350 has a stepped configuration and all of the members are generally rectangular in shape. The second side waveguide member 330 has an open first end 332 and an open second end 334 which is integrally connected to the common port 315 at a first side opening 336 formed in the first stepped region 318. The first side opening 336 has a shape that mirrors the shape of the second end 334 to permit direct communication between the interior of the common port 315 and the interior of the second side waveguide member 330. The second end 334 has a shape which is complementary to the first stepped region 318 due to the second end 334 extending outwardly from the first stepped region 318. Thus, the second end 334 has a stepped shape itself.

The second side waveguide member 330 has one or more stepped portions 337 formed between the first end 332 and the second end 334. The stepped portion 337 is an inwardly stepped portion in that the cross-sectional dimensions of the second side waveguide member 330 decrease from the first end 332 to the second end 334.

Similarly, the third side waveguide member 350 has an open first end 352 and an open second end 354 which is integrally connected to the common port 315 at a second side opening 356 formed in the second stepped region 320. The second side opening 356 has a shape that mirrors the shape of the second end 354 to permit direct communication between the interior of the common port 315 and the interior of the third side waveguide member 350. The third side waveguide member 350 has one or more stepped portions 357 formed between the first end 352 and the second end 354. The stepped portion 357 is an inwardly stepped portion in that the cross-sectional dimensions of the second side waveguide member 350 decrease from the first end 352 to the second end 354. The second end 354 has a shape which is complementary to the second stepped region 320 due to the second end 354 extending outwardly from the second stepped region 320.

Unlike the device 30 of FIG. 3, the N port feed device 300 includes the fourth waveguide member 370 which is a waveguide member that is connected to and extends outwardly from the first transmit port 316 at the third stepped region 323. The fourth waveguide member 370 has an open first end 372 and an open second end (not shown) which is integrally connected to the first transmit port 316 at a third side opening (not shown) formed in the third stepped region 323. The third side opening has a shape that mirrors the shape of the second end to permit direct communication between the interior of the first transmit port 316 and the interior of the fourth waveguide member 370. The fourth waveguide member 370 has one more stepped portions 377 formed between the first end 372 and the second end. The stepped portion 377 is an inwardly stepped portion in that the cross-sectional dimensions of the fourth waveguide member 370 decrease from the first end 372 to the second end. The second end has a shape which is complementary to the third stepped region 323 due to the second end 374 extending outwardly from the third stepped region 323.

The N port feed device 300 acts to separate polarized input signals that are received, i.e., through the feed horn, and channeled into the common port 315. For example, V and H polarity signals are channeled into the common port 315 and travel within the interior of the common port 315 toward the junction. The first and second side openings 336 and 356 function as coupling apertures which are configured to only permit a signal of a certain polarity pass therethrough into the second and third side waveguide members 330, 350, respectively. In one exemplary embodiment, the coupling aperture 336 is configured to accept the V polarity signal and pass this signal into the second side waveguide member 330. The coupling aperture 356 is configured to accept the H polarity signal and pass this signal into the third side waveguide member 350. In this embodiment, each of the second and third waveguide members 330, 350 acts as a receiver port which receives one type of polarity signal that has been channeled into the common port 315 and then separated into the corresponding V polarity receiver port 330 and H polarity receiver port 350. The receiver ports 330, 350 may be attached at their second end 334, 354, respectively, to a filter/LNB device or the like.

The first transmit port 316 is a transmit port which is adapted to be attached to an external device, such as a radio or the like. The first transmit port 316 receives first transmit signals which may be one polarity or a number of polarities, such as the H and V polarity signals that were previously-mentioned. The first transmit signals enter at the first end 312 and travel within the first to transmit port 316 to the junction where the first transmit signals enter the common port 315. As the transmit signals pass through the junction, the cross-sectional dimensions of the waveguide interior in which the first transmit signals are traveling increases in a direction toward to the first end 312.

The fourth waveguide member 370 also functions as a transmit port and the first end 372 thereof may be attached to an exterior device. The fourth waveguide member 370 receives second transmit signals (of one or more polarities). The second transmit signals enter the first end 372 and travel within fourth waveguide member 370 toward the second end and the third side opening. The second transmit signals travel through the third side opening (acting as a coupling aperture) and into the interior of the first transmit port 316. These second transmit signals are thus combined with the first transmit signals. Both the first and second transmit signals travel within the interior of the first transmit port 316 and into the common port 315, as previously-mentioned.

In one embodiment, transmit signals that are received within the first transmit port 316 have one polarity (e.g., V polarity) and transmit signals that are received within the fourth waveguide member 370 have, another polarity (H polarity). For example and due to the spatial relationships between the first transmit port 316 and the common port 315 and the fourth waveguide member 370 and the common port

315, the first transmit port 316 may be thought of as a transmit vertical port and the fourth waveguide member 370 may be thought of as a transmit horizontal port as it is generally perpendicular to the first transmit port 316.

Figure 10:
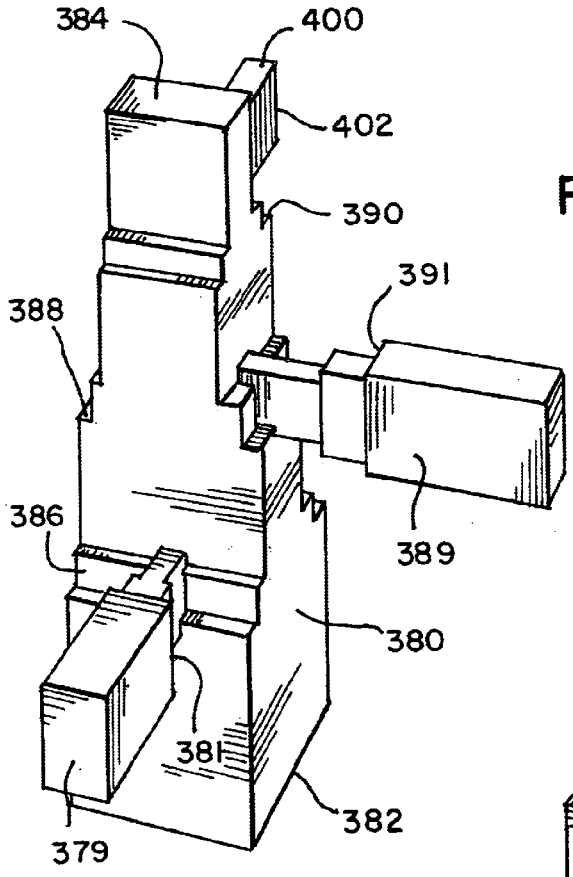
FIG. 10 is a perspective view of mandrel tools of another exemplary embodiment which engage one another to form the exemplary N port feed device of FIG. 8.

Referring to FIG. 10, as with the device 30 of FIG. 3, the N port feed device 300 is configured so that it may be cast as a single integral structure that requires no tuning operations and no assembly of different waveguide structures. Casting tools 301that are used to manufacture the N port feed device 300 are similar to the casting tools 100 shown in FIG. 4 with one difference being that a single main tool 380 is used to form the common port 315 and the first transmit port 316 (FIG. 8) instead of using two separate tools as in the casting manufacture of the device 30. Other differences are that a third tool 400 is added to the casting tools 301 and the orientation of first and second casting tools 379, 389 is different. The third tool 400 is provided to form the fourth waveguide member 370. The first tool 379 is used to form the waveguide 330 and the second tool 389 is used to form the waveguide 350 (FIG. 8). The first tool 379 has a series of stepped sections 381that mirror the outer contour of the waveguide 330 and the second tool 389 similarly has a series of stepped sections 391that mirror the outer contour of the waveguide 350.

More specifically, the main tool 380 has a shape and dimensions that mirror the interior dimensions of the first waveguide member 310. The main tool 380 thus has a closed first end 382 and a closed second end 384 with the first end 382 being associated with the common port 315 and the second end 384 being associated with the first transmit port 316. Because the main tool 380 is used to form the first waveguide member 310, the main tool 380 has a series of stepped regions. More specifically, the main tool 380 has a lower stepped region 386 corresponding to the first stepped region 318 and an intermediate stepped region 388 corresponding to the second stepped region 320, and an upper stepped region 390 corresponding to the stepped region 377. While, the two ends 382, 384 are closed, the interior of the main tool 380 can be solid or may be partially hollow.

The other difference between the casting tools 301 and the tools 100 is the positioning of the side casting tool 379 with respect to the casting tool 389. In the embodiment shown in FIG. 4, the side casting tools 150, 170 are aligned with one another along the longitudinal axis of the common port (i.e., common axis C), while in this embodiment, the third casting tool 379 is not axially aligned with the fourth casting tool 389. Instead, the third casting tool 379 is off set from the fourth casting tool 389 and is disposed closer to the first end 382 of the main tool 380.

The casting tools 301 also include the casting tool 400. The casting tool 400 has a shape and dimensions that mirror the interior dimensions of the fourth waveguide member 370. The tool 400 has a first distal end 402 and an opposing second end (not shown). The tool 400 has a series of stepped sections (not shown) which are stacked on one another. In this particular embodiment, each stepped section is generally rectangular in shape. As the sections extend toward the upper stepped region 390 of the main tool 380, the cross-sectional area of each section decreases. The proximal end has a stepped configuration complementary to the upper stepped region 390 so that the proximal end mates and seats against the upper stepped region 390 in one embodiment.

As with the casting tools 100, the casting tools 301 may be designed so that the other tools (i.e., the tools 379, 389) either seat against the outer surface of the main tool .380 or the main tool 380 may alternatively be provided with a number of recesses (not shown) for receiving proximal ends of the other tools. These recesses are formed at locations where the other tools are meant to engage and be held against the main tool 380. The proximal ends of the other tools are received in the corresponding recesses so as to locate and partial retain these tools in desired casting locations. As previously-mentioned, the fit between the distal ends and the recesses should be an intimate one to prevent any casting material from seeping between the outer surfaces of the tools and the inner surfaces of the recesses.

It will also be appreciated that while the first waveguide member 310 has a number of stepped sections (which are likewise present in the main tool 380), the first waveguide member 310 may be cast so that it alternatively has a series of tapered (beveled) sections instead of the stepped sections. In this embodiment, the waveguide members extend outwardly from the first waveguide member 310 at the respective tapered sections, similar to side ports 80, 90 illustrated in FIG. 3. Due to the arrangement of the waveguides relative to the longitudinal axis of the first waveguide member 310, three tapered (beveled) sections are be formed along this axis. Each tapered section tapers in an inward direction so that the cross-sectional dimensions of the first waveguide member 310 progressively decrease in the direction from the first end 312 to the second end 314.

Figure 11:
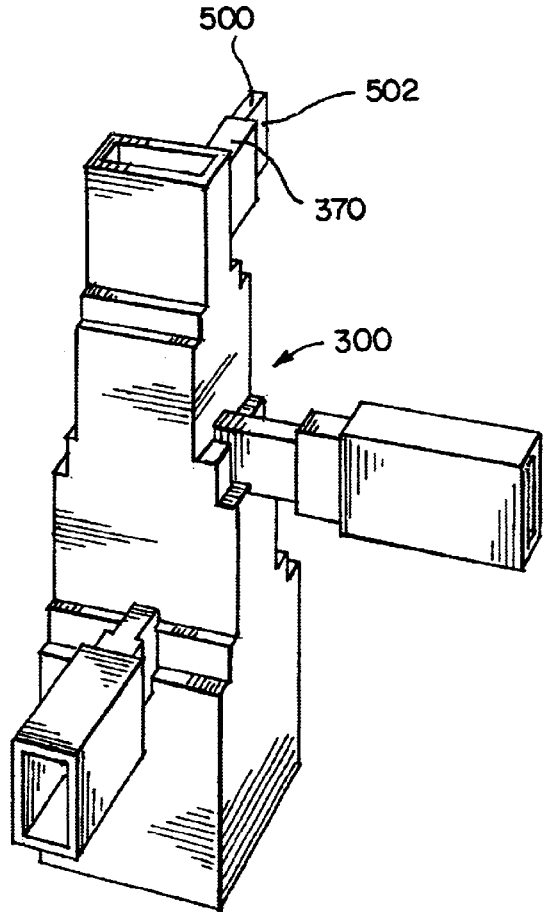
FIG. 11 is a perspective view of an N port feed device according to another exemplary embodiment illustrating the use of a plug.

Now turning to FIG. 11in which another embodiment is shown. In this embodiment, the waveguide 300 is shown along with a waveguide plug 500, shown in a partially exploded manner relative to the waveguide 300. Generally, the plug 500 is used to seal one of the waveguide members of the waveguide 300 and more specifically, it is preferably intended to seal one of the side waveguide members. The plug 500 has a first end 502 and a second end (not shown) with preferably both the first and second ends are closed. The plug 500 has a shape that is complementary to the side waveguide member that receives the plug 500.

For example, the plug 500 may be used to seal the waveguide member, which serves as the transmit horizontal waveguide. The sealing of the fourth waveguide member 370 will thereby convert the waveguide 300 from a two transmit port arrangement to a single transmit port arrangement, similar to that shown in FIG. 3. It will be understood that the plug 500 may be used to seal one of the receive waveguide members, especially when the waveguide has two or more receive waveguide members.

The plug 500 is designed to provide a simple, non-permanent manner of eliminating one of the waveguide members of the waveguide 300. The plug 500 may be formed of any number of materials and while the waveguide itself is formed of a casting material, the plug 500 may be formed from non-castable materials. In other words, a large variety of materials may be used to form the plug 500 including but not limited to plastic materials. Because the plug 500 is inserted into one of the waveguide members, the outer dimensions of the plug 500 should be approximately equal to the inner dimensions of the waveguide that the plug 500 is inserted into. The length of the plug 500 should be such that the second distal end 504 is received within the coupling aperture formed in the first transmit port 316; however, the second end should not extend into the interior of the first transmit port 316 as this may produce an interference with the signals being carried therein. The second proximal end serves to completely enclose the coupling aperture 376, thereby preventing signals from communicating between the interior of the first transmit port 316 and the interior of the fourth waveguide member 370.

The use of plug 500 offers a simple yet effective manner of closing off one of the waveguide members. This permits the user to purchase one waveguide and then alter its performance capabilities by simply inserting the plug 500 into one of the waveguide members. Costs are significantly reduced because separate waveguide members do not have to be purchased for each application but rather one waveguide may be purchased along with one or more plugs 500. Of course, if the side waveguide members have different dimensions, then a plurality of plugs 500 will be needed to mate with the side waveguide having complementary dimensions.

The N port feed devices disclosed herein are carefully configured so that each has a shape that permits the device to be die cast as a single integral cast structure. Other advantageous features of the N port feed devices are that they accommodate broad band signals, they do not require tuning, and permit the use of separate existing filters. Because a die casting operation is relatively of low cost, the N port feed devices may be produced at lower costs and the manufacturing time is significantly reduced as the devices do not require post manufacture assembly unlike most conventional devices.

Although generally rectangular waveguide structure is shown, those of skill in the art will recognize that other configurations may also be used, particularly if the frequency bands of the two polarities of the signals to be carried are not the same, i.e., f(v) and f(h) are different or the expected bandwidth of the V and H signals is not the same.

The term "progressively" is used throughout the present application. This term includes a cross-sectional configuration in which the cross-sectional dimensions decrease in stages (e.g., as illustrated in FIG. 3); however, it will also be understood that other embodiments are covered by the present application, such as those in which the cross-sectional dimensions continuously decrease along the length of the waveguide from one end to another end. The manner in which the cross-section decreases from one end to the other end is not critical so long as the waveguide does not increase in cross-sectional size along its length from the one end to the other end, where the one end has the greatest cross-sectional dimensions. In other words, the waveguide can include stepped sections where each section has uniform cross-sectional dimensions with the dimensions of the sections decreasing from one end to the other end. This is exemplified in FIG. 3 where a series of rectangular sections are stacked on one another such that adjacent sections have different cross-sectional dimensions. Alternatively, one or more sections can have varying cross-sectional dimensions so long as the dimensions decrease in a direction from the one end to the other end.

While the invention has been particularly shown and described with reference to preferred embodiments thereof, it will be understood by those skilled in the art that various changes in form and details may be made therein without departing from the spirit and scope of the invention.

We claim:

1. A waveguide device comprising:

a first waveguide member aligned along a first axis and configured to carry a first signal having first and second polarities, the first waveguide member having cross-sectional dimensions that decrease along the first axis from a first distal end to a second proximal end thereof;

a second waveguide member aligned along the first axis and configured to carry a second signal having at least one polarity, the second waveguide member communicating with the first waveguide member through a first coupling aperture, the second waveguide member having cross-sectional dimensions that decrease along the first axis from a first distal end to a second proximal end thereof, the second proximal end of the second waveguide member being adjacent the second proximal end of the first waveguide member;

third and fourth waveguide members in communication with an interior of the first waveguide member, the first signal being separated by the first waveguide member such that the first polarity is carried within the third waveguide member and discharged at a first distal end thereof and the second polarity is carried within the fourth,waveguide member and discharged at a first distal end thereof, the third waveguide member having cross-sectional dimensions that decrease along a second axis from the first distal end to a second proximal end thereof, the fourth waveguide member having cross-sectional dimensions that decrease along a third axis from the first distal end to a second proximal end thereof; and wherein the waveguide device is of an integral cast construction.

2. The waveguide device of claim 1, wherein the device is of a non-tunable construction.

3. The waveguide device of claim 1, wherein the first waveguide member is a common port for attachment to a feed horn, the second waveguide member being a transmit port and the third and fourth waveguide members being receive ports.

4. The waveguide device of claim 1, wherein the first waveguide member has a first section and a second section, the first section extending from the first end to a first junction, the second section extending from the first junction to the second end, the first section having uniform cross-sectional dimensions, the second section being tapered so that the cross-sectional dimensions decrease from the first junction to the second end.

5. The waveguide device of claim 4, wherein the second section tapers inwardly and forms a platform at the second end of the second proximal end of the first waveguide member, the first coupling aperture being formed in the platform.

6. The waveguide device of claim 4, wherein the first section has a rectangular shape and the second section has a rectangular, conical shape.

7. The waveguide device of claim 1, wherein the second waveguide member has a stepped construction defined by a plurality of stepped sections, the cross-sectional dimensions of each stepped section progressively decreasing from an outermost stepped section at the first distal end to an innermost stepped section at the second proximal end.

8. The waveguide device of claim 7, wherein the innermost stepped section is integral with a platform formed at the second proximal end of the first waveguide member, the first coupling aperture being formed in the platform.

9. The waveguide device of claim 1, wherein the third waveguide member has a stepped construction defined by a plurality of stepped sections, the cross-sectional dimensions of the stepped sections progressively decreasing from an outermost stepped section at the first distal end to an innermost stepped section at the second proximal end.

10. The waveguide device of claim 9, wherein a second coupling aperture is formed in the first waveguide member permitting communication between the first and third waveguide members, the second coupling aperture being configured to permit entry of only the first polarity of the first signal into the third waveguide member.

11. The waveguide device of claim 10, wherein the second coupling aperture is formed along first and second sections of the first waveguide member, the first section having a uniform cross-section, the second section having a tapered construction with cross-sectional dimensions that decrease toward the second proximal end thereof.

12. The waveguide device of claim 1, wherein the fourth waveguide member has a stepped construction defined by a plurality of stepped sections, the cross-sectional dimensions of the stepped sections progressively decreasing from an outermost stepped section at the first distal end to an innermost stepped section at the second proximal end.

13. The waveguide device of claim 12, wherein a third coupling aperture is formed in the first waveguide member permitting communication between the first and fourth waveguide members, the third coupling aperture being configured to permit entry of only the second polarity of the first signal into the fourth waveguide member.

14. The waveguide device of claim 13, wherein the third coupling aperture is formed along first and second sections of the first waveguide member, the first section having a uniform cross-section, the second section having a tapered construction with cross-sectional dimensions that decrease toward the second proximal end thereof.

15. The waveguide device of claim 1, wherein the third and fourth waveguide members are displaced 90° from one another relative to the first axis.

16. The waveguide device of claim 1, wherein the third and fourth waveguide members are aligned with one another with respect to the first axis of the first waveguide member.

17. The waveguide device of claim 1, wherein the third and fourth waveguide members are displaced from another along the first axis of the first waveguide member.

18. The waveguide device of claim 1, wherein each of the first, second, third and fourth waveguides is shaped so that the smallest cross-sectional dimensions are at the proximal second end of each member.

19. The waveguide device of claim 1, further including a waveguide plug for reception in one of the waveguide members excluding the first waveguide member, the plug sealing the one waveguide from the first waveguide member and preventing communication therebetween.

20. The waveguide device of claim 1, wherein the third and fourth waveguide members extend perpendicularly outward from the first waveguide member.

21. A non-tunable waveguide device comprising:

a first waveguide member configured to carry a first signal having first and second polarities;

a second waveguide member co-axially aligned with the first waveguide member and configured to carry a second signal having at least one polarity, the second waveguide member communicating with the first waveguide member through a first coupling aperture;

third and fourth waveguide members in communication with an interior of the first waveguide member, the first signal being separated by the first waveguide member such that the first polarity is carried within the third waveguide member and the second polarity is carried within the fourth waveguide member; and wherein each of the first, second, third and fourth waveguide members has a cross-section that progressively decreases along an axis containing the waveguide and from a distal end to a proximal end thereof and wherein the waveguide device is of an integral cast construction.

22. The waveguide device of claim 21, wherein the first waveguide member is a common port, the second waveguide is a transmit port, and the third and fourth waveguide members are receive ports extending outwardly from the first waveguide member.

23. The waveguide device of claim 21, where each of the first, second, third and fourth waveguide members has a stepped construction defined by a series of stepped sections stacked on top of one another.

24. The waveguide device of claim 21, further including a fifth waveguide integrally formed with the second waveguide member and in communication therewith.

25. The waveguide device of claim 24, wherein the second waveguide member is a vertical transmit port and the fifth waveguide member is a horizontal transmit port, the fifth waveguide member extending perpendicularly outward from the second waveguide member.

26. The waveguide device of claim 24, further including a waveguide plug for reception in one of the waveguide members excluding the first waveguide member, the plug sealing the one waveguide from one of the first and second waveguide members and preventing communication therebetween.

27. A non-tunable waveguide device comprising:

a first waveguide member having a first end and a second end with an intermediate section therebetween partitioning the first waveguide member into first and second sections that are coaxially aligned with one another, the first section configured to carry a first signal having first and second polarities, the second section configured to carry a second signal having at least one polarity;

second and third waveguide members in communication with an interior of the first section of the first waveguide member, the first signal being separated within the first section prior to reaching the second section such that the first polarity is carried within the second waveguide member and the second polarity is carried within the third waveguide member; and wherein each of the first, second and third waveguide members has a cross-section that decreases in a stepped manner along an axis containing the waveguide and from a distal end to a proximal end thereof, wherein the second waveguide member is coupled to the first section at a first stepped region thereof and the third waveguide is coupled to the first section at a second stepped region thereof, and wherein the waveguide device is of an integral cast construction.

28. The waveguide device of claim 27, further including a fourth waveguide member in communication with the second section of the first waveguide member, the fourth waveguide member integrally attached to the first waveguide member and extending outwardly therefrom.

29. The waveguide device of claim 27, wherein the first waveguide member has a stepped construction formed of a plurality of stepped sections provided along its axis from the first end to the second end.

30. A method of forming a waveguide device which is of an integral cast construction, the method comprising the steps of:

providing a first casting tool having a cross-section that progressively decreases from a first end to a second end;

providing a second casting tool having a cross-section that progressively decreases from a first end to a second end, the second end seating against the second end of the first casting tool;

providing a third casting tool having a cross-section that progressively decreases from a first end to a second end, the second end seating against the first casting tool at a first location;

providing a fourth casting tool having a cross-section that progressively decreases from a first end to a second end, the second end seating against the first casting tool at a second location;

positioning a casting shell around the first, second, third and fourth casting tools; and disposing casting material between the casting shell and the first, second, third and fourth tools, the casting material subsequently cooling to form the waveguide device formed of an integral cast construction.

31. The method of claim 30, wherein the first casting tool has first and second sections, the first section having a uniform cross-section, the second section have an inwardly tapered construction terminating with a planar platform formed at the second end of the first casting tool, the second end of the second casting tool being planar and in contact with the planar platform, the second end of each of the third and fourth casting tools having a beveled section in contact with the second section of the first casting tool, a non-beveled section of the second end of each of the third and fourth casting tools seating against the first section of the first casting tool.

32. The method of claim 30, wherein the second ends of the second, third and fourth casting tools are received within recesses formed in the first casting tool.

* * * * *

UNITED STATES PATENT AND TRADEMARK OFFICE

CERTIFICATE OF CORRECTION

PATENT NO. : 6,621,375 B2
DATED : September 16, 2003
INVENTOR(S) : John Vezmar et al.

It is certified that error appears in the above-identified patent and that said Letters Patent is hereby corrected as shown below:

Title page,
Item [22], Filing Date, delete "March 21, 2002" and substitute -- October 24, 2001 --.

Signed and Sealed this

Thirteenth Day of July, 2004

JON W. DUDAS
*Acting Director of the United States Patent and Trademark Office*